US010132562B2

(12) United States Patent
Zick

(10) Patent No.: US 10,132,562 B2
(45) Date of Patent: Nov. 20, 2018

(54) PROCESS AND DEVICE FOR THE CRYOGENIC SEPARATION OF A METHANE-RICH STREAM

(75) Inventor: Golo Zick, Fontaine (FR)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 730 days.

(21) Appl. No.: 13/983,335

(22) PCT Filed: Feb. 8, 2012

(86) PCT No.: PCT/FR2012/050269

§ 371 (c)(1),
(2), (4) Date: Aug. 2, 2013

(87) PCT Pub. No.: WO2012/107688

PCT Pub. Date: Aug. 16, 2012

(65) Prior Publication Data

US 2013/0312457 A1 Nov. 28, 2013

(30) Foreign Application Priority Data

Feb. 9, 2011 (FR) ..... 11 51013

(51) Int. Cl.
*F25J 3/00* (2006.01)
*F25J 3/06* (2006.01)
(Continued)

(52) U.S. Cl.
CPC ..... *F25J 3/061* (2013.01); *F25J 3/0209* (2013.01); *F25J 3/0233* (2013.01); *F25J 3/0257* (2013.01);
(Continued)

(58) Field of Classification Search
CPC .. F25J 3/02; F25J 3/0204; F25J 3/0257; F25J 3/002; F25J 5/005; F25J 2210/40;
(Continued)

(56) References Cited

U.S. PATENT DOCUMENTS 2,519,955 A 8/1950 Deming
3,989,478 A 11/1976 Jones
(Continued)

FOREIGN PATENT DOCUMENTS

DE 4425712 A1 * 1/1996
DE 102007010032 A1 9/2008
WO 2009004207 A2 1/2009

OTHER PUBLICATIONS

Carson, Phillip A. Mumford, Clive J . . . (2002). Hazardous Chemicals Handbook (2nd Edition). Chapter 8. p. 258. Elsevier.*
(Continued)

*Primary Examiner* — Keith Raymond
*Assistant Examiner* — Webeshet Mengesha
(74) *Attorney, Agent, or Firm* — Justin K. Murray

(57) ABSTRACT

In a process for the cryogenic separation of a methane-rich feed stream containing between 3 and 35% of oxygen and also nitrogen, the feed stream is cooled in order to produce a cooled stream, at least one portion of the cooled stream is sent to a distillation column, a bottom stream is withdrawn from the distillation column, the bottom stream being enriched in methane compared to the feed stream, a stream enriched in oxygen compared to the feed stream is withdrawn from the distillation column, and a nitrogen-rich stream is sent to the column.

10 Claims, 2 Drawing Sheets

(51) Int. Cl.
*F25J 3/02* (2006.01)
*F25J 3/04* (2006.01)

(52) U.S. Cl.
CPC ..... *F25J 3/04563* (2013.01); *F25J 2200/02* (2013.01); *F25J 2200/70* (2013.01); *F25J 2210/40* (2013.01); *F25J 2210/42* (2013.01); *F25J 2210/66* (2013.01); *F25J 2260/44* (2013.01); *F25J 2270/904* (2013.01); *F25J 2280/10* (2013.01); *F25J 2290/90* (2013.01)

(58) Field of Classification Search
CPC .. F25J 2210/42; F25J 2210/50; F25J 2210/60; F25J 2210/66; F25J 2215/42; F25J 2215/50; F25J 2215/60; F25J 2220/44; F25J 2220/60; F25J 2220/66; F25J 2220/68
USPC ..... 62/617, 618, 620
See application file for complete search history.

(56) References Cited

U.S. PATENT DOCUMENTS

| | | | | |
|---|---|---|---|---|
| 4,878,932 | A * | 11/1989 | Phade et al. | 62/620 |
| 5,067,976 | A * | 11/1991 | Agrawal | F25J 3/04412 423/262 |
| 5,893,274 | A * | 4/1999 | Nagelvoort et al. | 62/613 |
| 2003/0206849 | A1* | 11/2003 | Griffiths et al. | 423/262 |
| 2006/0043000 | A1 | 3/2006 | Gaskin | |
| 2010/0192627 | A1* | 8/2010 | Briend | 62/620 |
| 2010/0275646 | A1* | 11/2010 | Bauer et al. | 62/620 |

OTHER PUBLICATIONS

FR 1151013, Search Report and Written Opinion, dated Nov. 23, 2011.

* cited by examiner

PROCESS AND DEVICE FOR THE CRYOGENIC SEPARATION OF A METHANE-RICH STREAM

CROSS REFERENCE TO RELATED APPLICATIONS

This application is a § 371 of International PCT Application PCT/FR2012/050269, filed Feb. 8, 2012, which claims the benefit of FR 1151013, filed Feb. 9, 2011, both of which are herein incorporated by reference in their entireties.

TECHNICAL FIELD OF THE INVENTION

The present invention concerns a method and apparatus for the cryogenic separation of a methane-rich feed stream.

BACKGROUND

In order to purify a methane-rich stream coming from an organic source, so as to produce a purified product, it is necessary to remove the impurities, such a carbon dioxide, oxygen and nitrogen. Ideally the product contains less than 2% carbon dioxide and less than 2% for the total oxygen and nitrogen content.

In this context, a methane-rich stream contains at least 30% methane.

All the composition percentages in this document are molar percentages.

Biogas, coming for example from an installation storing non-dangerous waste, is a mixture of methane, carbon dioxide, nitrogen, oxygen and traces of other impurities such as water and hydrogen sulfide or volatile organic compounds (VOCs).

For reprocessing methane as a biofuel or for injection into the natural gas system, purification is necessary. The impurities present in traces may easily be stopped in adsorption beds or other methods known to persons skilled in the art.

A few remarks concerning the presence of oxygen in natural gas are found in US-A-2006/0043000. The percentage of oxygen in natural gas does not exceed 0.1% according to other sources.

$CO_2$ and $CH_4$ are preferably separated by permeation in a membrane system. Membranes do not however make it possible to separate methane from the gases in air economically; however, it is necessary to comply with demanding purity requirements for injecting biogas into the natural gas system. It is then necessary to find a supplementary means for separating methane from gases in the air. Offers using an adsorption system for this are found at the present time on the market. This solution has several drawbacks, such as low efficiency, many wearing parts or very bulky adsorbent bottles and buffer vessels.

Another solution for separation is cryogenic distillation as described in WO-A-09/004207. This may achieve very high efficiencies, works continuously and requires only very little maintenance.

However, with the presence of oxygen in the mixture to be separated, the problem of flammability of the methane/oxygen binary is posed following the superconcentration of oxygen in the middle of the distillation column. Even very small quantities of oxygen in a feed far from being flammable accumulate in the column and may create a dangerous situation.

This problem has not been dealt with in the prior art, as can be seen from U.S. Pat. No. 2,519,955, where a gas containing oxygen (air) is actually deliberately introduced into a natural gas distillation column devoid of oxygen.

A catalytic deoxygenizer could solve this problem but gives rise to other problems such as the addition of a supplementary element in the method, the creation of water and $C_nH_m$ or even carbon or a potentially lower reliability of the biogas purification assembly.

SUMMARY OF THE INVENTION

One aim of the present invention is to find a solution in the form of a method that always provides operation of the distillation column outside the flammability zone.

Hereinafter feed stream means the stream entering the cold box, that is to say in the whole of the cryogenic distillation brick; this stream is already purified of $CO_2$ and other impurities cited above.

In the ternary diagram in FIG. 1, the triangular flammability zone is hatched. The continuous line traces the composition of the vapor phase between the head of the column at the bottom right of the diagram and in the column bottom where pure methane is found. It can be easily seen that this line passes through the flammability zone.

One possibility of avoiding this zone if the feed composition is fixed is an enrichment of the composition with nitrogen as is traced with the broken line.

According to an embodiment of the invention, a nitrogen enrichment is performed by adding a nitrogen-rich stream in the distillation column. It is preferred to inject the nitrogen into the lower part of the column in order to avoid the flammability zone through the entire column.

According to one object of the invention, a method for the cryogenic separation of a methane-rich feed stream containing oxygen and nitrogen is provided, wherein:

i) the feed stream is cooled in order to produce a cooled stream, ii) at least part of the cooled stream is sent to a distillation column, iii) a bottom stream is withdrawn from the distillation column, the bottom stream being enriched with methane compared with the feed stream, iv) a stream enriched with oxygen compared with the feed stream is withdrawn from the distillation column, and v) a nitrogen-rich gaseous stream coming from an external source is sent to a lower part of the distillation column in order to participate in the distillation characterized in that the feed stream contains between 3% and 35% oxygen.

According to other optional features:

the feed stream contains between 65% and 97% methane;

the feed stream contains between 3% and 35% in total nitrogen and oxygen;

the feed stream contains between 3% and 35% nitrogen;

the nitrogen-rich stream contains at least 90% nitrogen, or even at least 95% nitrogen;

the nitrogen-rich stream is sent to the bottom of the distillation column;

the feed stream is sent to a condenser/reboiler where it partially vaporizes the bottom liquid in order to form a vaporized gas, the completely or partially liquefied feed stream is sent from the condenser/reboiler to the column and the vaporized gas is mixed with nitrogen-rich stream;

a nitrogen-rich liquid stream is vaporized by heat exchange with the feed stream in order to produce the nitrogen-rich gaseous stream;

the feed stream contains less than 10% oxygen.

According to another object of the invention, an apparatus for the cryogenic separation of a methane-rich feed stream containing oxygen and nitrogen is provided, comprising:

i) a heat exchanger for cooling the feed stream in order to produce a cooled stream, ii) a condenser/reboiler iii) a distillation column and means for sending at least part of the cooled stream to the condenser/reboiler, iv) means for withdrawing from the distillation column a liquid enriched with methane compared with the feed stream and for sending it to the condenser/reboiler, v) means for withdrawing from the condenser/reboiler a methane-rich liquid and for sending it to the exchanger, vi) means for withdrawing from the condenser/reboiler a methane-rich gas and for sending it to the bottom of the column, vii) means for withdrawing from the distillation column a stream enriched with nitrogen and/or oxygen compared with the feed stream, and viii) means for sending a nitrogen-rich liquid to vaporize in the exchanger and means for sending the nitrogen-rich gaseous stream thus formed to a bottom part of the column mixed with methane-rich gas in order to participate in the distillation.

The apparatus may comprise a storage for the nitrogen-rich liquid connected to the means for sending the liquid to vaporize in the exchanger.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

Figure 1:
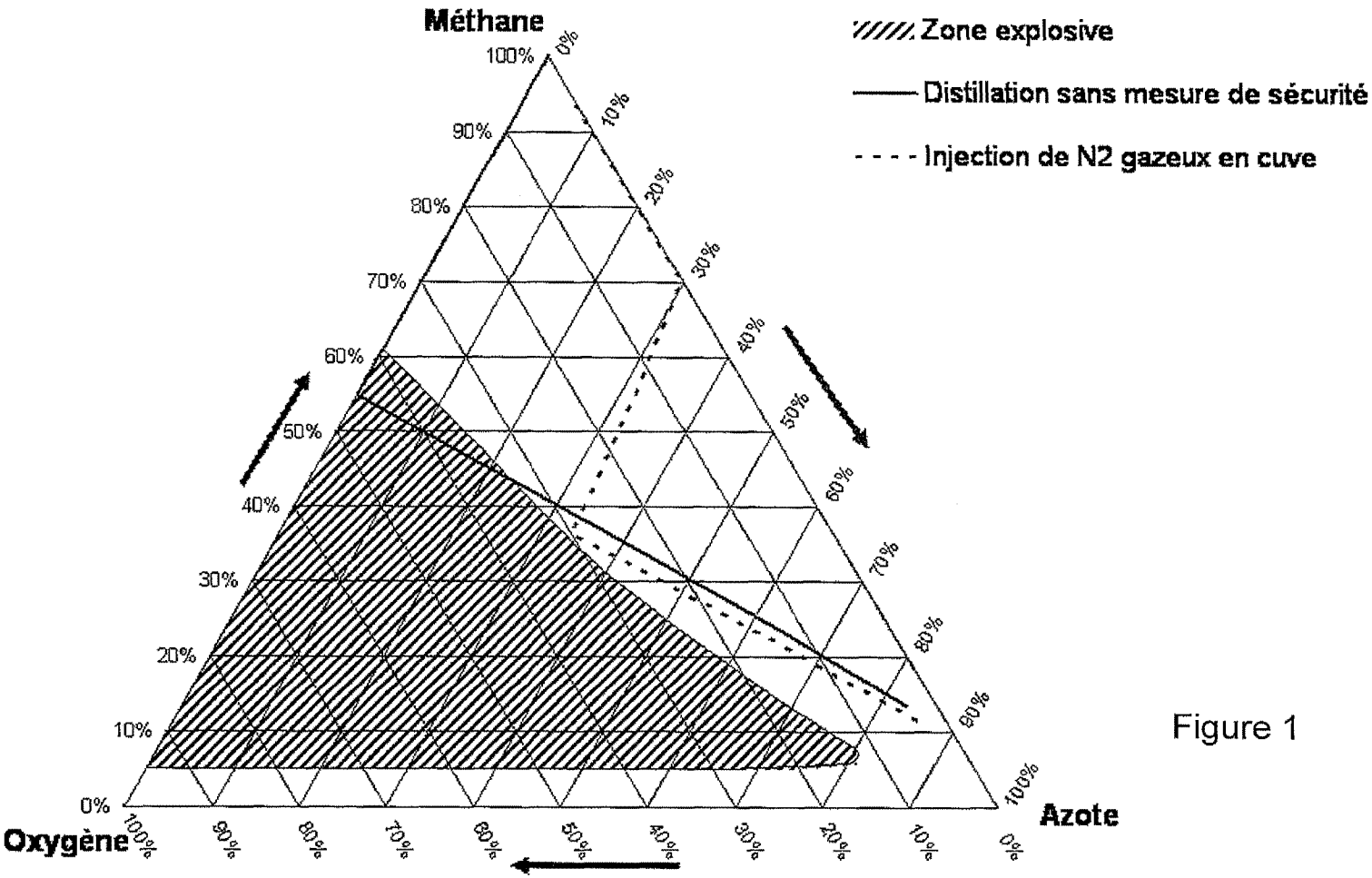
FIG. 1 shows a ternary diagram.
Figure 2:
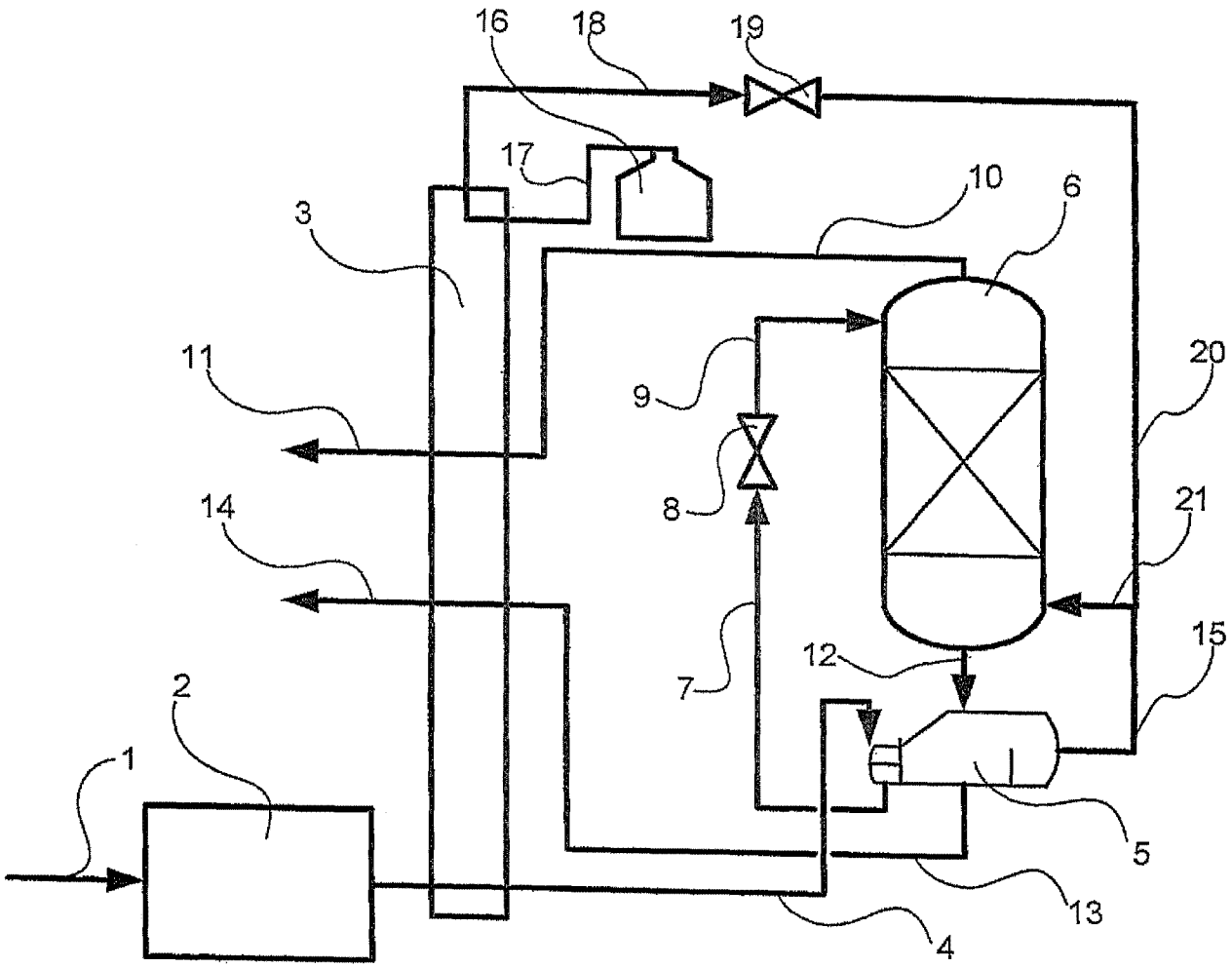
FIG. 2 shows diagram in accordance with an embodiment of the present invention.

The invention will be described in more detail with reference to the figures, FIG. 2 of which shows a simplified diagram of the method according to the invention.

A stream of feed gas 1, which may be biogas, comprises between 30% and 50% methane, with a $CH_4/CO_2$ ratio of between 1 and 2. It also contains air gases with a nitrogen/oxygen ratio greater than 3.7 and is saturated with water. The gas 1 is purified by drying and desulfurization and to eliminate the carbon dioxide that it contains by permeation and/or adsorption in a treatment unit 2, so that it substantially contains nothing more than methane, nitrogen and oxygen. A typical composition of the treated gas 4 could be 68% methane, 31% nitrogen and 3% oxygen. This feed gas 4 produced by the treatment unit 2 is cooled in a heat exchanger 3 of the blade or fin type at a pressure of between 6 and 15 bar. The gas 4 is sent to a condenser/reboiler 5 of a simple distillation column 6. The gas cools in the condenser/reboiler 5 and is at least partially condensed, while heating the bottom of the column 6. The fluid 7 produced by condensing the gas 4 is expanded in a valve 8 at a pressure between 1.1 and 5 bar absolute and then sent to the head of the column 6 as a liquid 9. The temperature of the liquid 9 must be greater than 90.7K in order avoid the risk of solidifying the methane.

This liquid then separates in the column 6 in order to form a head gas 10 containing 84% nitrogen and 5% oxygen. This gas 10 heats in the exchanger 3 in order to form the residual gas 11. The bottom liquid 12 of the column 6 is withdrawn with a composition of less than 100 ppm of oxygen, traces of nitrogen and the rest being methane. The bottom liquid 12 is sent to the reboiler 5, where it partially vaporizes. The gas 15 formed is sent to the column bottom through the pipe 21. The remaining bottom liquid 13 vaporizes in the exchanger 3 in order to form a pure gaseous methane product 14.

A liquid nitrogen storage 16 is connected to the exchanger 3 by a pipe 17 in order to vaporize the liquid nitrogen. The vaporized nitrogen 18 is sent through a pressure-reducing valve 19 and the pipe 20 to the bottom of the column 6, mixed with the vaporized methane 15 coming from the reboiler 5. The vaporized nitrogen contains at least 90% nitrogen, or even at least 95% nitrogen. Mixing the nitrogen with the vaporized methane better disperses the nitrogen in the column and avoids the formation of flammable "pockets".

In order to start up the column 6, the storage 16 contains liquid nitrogen for inerting the column.

The nitrogen 20 may also come from an air-separation apparatus producing gaseous nitrogen or a gaseous nitrogen system. Otherwise liquid nitrogen from an air-separation apparatus may vaporize in the exchanger 3 in order to supply the gas 20.

The feed gas may contain up to 10% oxygen or up to 5% oxygen.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary a range is expressed, it is to be understood that another embodiment is from the one.

Optional or optionally means that the subsequently described event or circumstances may or may not occur. The description includes instances where the event or circumstance occurs and instances where it does not occur.

Ranges may be expressed herein as from about one particular value, and/or to about another particular value. When such particular value and/or to the other particular value, along with all combinations within said range.

All references identified herein are each hereby incorporated by reference into this application in their entireties, as well as for the specific information for which each is cited.

The invention claimed is:

1. A method for the cryogenic separation of a methane-rich feed stream containing oxygen and nitrogen, the method comprising the steps of:

i) cooling the methane-rich feed stream to produce a cooled stream;

ii) introducing at least a portion of the cooled stream to a distillation column under conditions effective for a distillation of the cooled stream, the distillation column having a distillation section;

iii) withdrawing a bottom stream from the distillation column, the bottom stream being enriched with methane compared with the methane-rich feed stream;

iv) withdrawing an oxygen-enriched stream from the distillation column, the oxygen-enriched stream having a higher percentage of oxygen as compared with the methane-rich feed stream; and v) introducing a nitrogen-rich gaseous stream coming from an external source to a lower part of the distillation column, such that the nitrogen-rich gaseous stream participates in the distillation of the cooled stream; and vi) wherein the nitrogen-rich gaseous stream introduced in step v) is in an amount effective to prevent a ternary mixture of methane, oxygen, and nitrogen of having a ternary concentration falling within a flammability zone for the ternary mixture while within the distillation column, wherein the methane-rich feed stream contains between 3% and 35% oxygen.

2. The method as claimed in claim 1, wherein the methane-rich feed stream contains between 65% and 97% methane.

3. The method as claimed in claim 1, wherein the methane-rich feed stream contains between 3% and 35% in total nitrogen and oxygen.

4. The method as claimed in claim 1, wherein the methane-rich feed stream contains between 3% and 35% nitrogen.

5. The method as claimed in claim 1, wherein the nitrogen-rich gaseous stream contains at least 90% nitrogen, or even at least 95% nitrogen.

6. The method as claimed in claim 1, wherein the nitrogen-rich gaseous stream is sent to a bottom of the distillation column, wherein the bottom of the distillation column is a portion of the distillation column that is located below the distillation section.

7. The method as claimed in claim 1, wherein the methane-rich feed stream is sent to a condenser/reboiler where the methane-rich feed stream is at least partially condensed while partially vaporizing a bottom liquid in order to form a vaporized gas and an at least partially liquefied feed stream, the at least partially liquefied feed stream is sent from the condenser/reboiler to the distillation column and the vaporized gas is mixed with the nitrogen-rich gaseous stream.

8. The method as claimed in claim 1, wherein a nitrogen-rich liquid stream is vaporized by exchange of heat with the methane-rich feed stream in order to produce the nitrogen-rich gaseous stream.

9. The method as claimed in claim 1, wherein the methane-rich feed stream contains between 3% and 10% oxygen.

10. A method for the cryogenic separation of a methane-rich feed stream containing oxygen and nitrogen, the method comprising the steps of:

i) cooling the methane-rich feed stream to produce a cooled stream;

ii) introducing at least a portion of the cooled stream to a distillation column under conditions effective for a distillation of the cooled stream to create a bottom stream and a top stream, wherein the bottom stream is enriched with methane compared with the methane-rich feed stream, wherein the top stream is enriched with oxygen as compared with the methane-rich feed stream;

iii) withdrawing the bottom stream from the distillation column;

iv) withdrawing the top stream from the distillation column; and v) introducing an effective amount of a nitrogen-rich gaseous stream to a lower part of the distillation column, wherein the nitrogen-rich gaseous stream comes from an external source, wherein the effective amount of the nitrogen-rich gaseous stream is based on an amount of nitrogen needed to prevent a ternary mixture of methane, oxygen, and nitrogen of having a ternary concentration falling within a flammability zone for the ternary mixture while within the distillation column, wherein the methane-rich feed stream contains between 3% and 35% oxygen.

* * * * *